US006896544B1

(12) United States Patent
Kuelbs et al.

(10) Patent No.: US 6,896,544 B1
(45) Date of Patent: May 24, 2005

(54) LIGHTED BATTERY CABLES

(75) Inventors: Gregory G. Kuelbs, Westlake, TX (US); Max A. Probasco, Plano, TX (US)

(73) Assignee: World Factory, Inc., Southlake, TX (US)

( * ) Notice: Subject to any disclaimer, the term of this patent is extended or adjusted under 35 U.S.C. 154(b) by 0 days.

(21) Appl. No.: 10/800,878

(22) Filed: Mar. 15, 2004

(51) Int. Cl.[7] ..... H01R 11/00
(52) U.S. Cl. ..... 439/504
(58) Field of Search ..... 439/502, 503, 439/504

(56) References Cited

U.S. PATENT DOCUMENTS

| | | | | | |
|---|---|---|---|---|---|
| 3,259,754 | A | * | 7/1966 | Matheson | 307/85 |
| 3,267,452 | A | | 8/1966 | Wolf | 340/249 |
| 3,456,181 | A | * | 7/1969 | Godshalk | 320/105 |
| D226,001 | S | | 1/1973 | Coleman et al. | D26/1 |
| 4,897,044 | A | | 1/1990 | Rood | 439/504 |
| 4,938,712 | A | | 7/1990 | Black | 439/490 |
| 4,975,089 | A | * | 12/1990 | Lee | 439/755 |
| 5,230,637 | A | | 7/1993 | Weber | 439/504 |
| D346,149 | S | | 4/1994 | Deering | D13/120 |
| D351,372 | S | | 10/1994 | Donovan, Jr. | D13/120 |
| D358,366 | S | | 5/1995 | Sciortino | D13/120 |
| 5,420,767 | A | | 5/1995 | Jones | 362/109 |
| D378,619 | S | | 3/1997 | Ng | D26/38 |
| 6,155,870 | A | * | 12/2000 | Valentine | 439/504 |
| 6,254,426 | B1 | | 7/2001 | Iacovelli et al. | 439/504 |
| 6,471,540 | B1 | * | 10/2002 | Fernandez | 439/490 |
| 6,527,585 | B1 | * | 3/2003 | Pannone | 439/504 |
| 6,638,101 | B1 | | 10/2003 | Botelho | 439/504 |

* cited by examiner

*Primary Examiner*—Ross Gushi
(74) *Attorney, Agent, or Firm*—James E. Walton

(57) ABSTRACT

A battery cable assembly has a pair of electrical cables and at least one pair of clamps, each clamp being connected to one end of one of the cables for establishing electrical connection between the cables and electrical terminals of a battery. A light source is mounted on at least one of the clamps, the light source being powered by an electrical source that is independent of the battery and located remote to the clamps. A switch, which is located remote to the clamps, controls the flow of electricity from the electrical source to the light source, allowing an operator to selectively activate the light source for illuminating objects near the corresponding clamp prior to connection to the battery.

24 Claims, 2 Drawing Sheets

LIGHTED BATTERY CABLES

BACKGROUND OF THE INVENTION

1. Field of the Invention

The present invention relates in general to the field of battery cables for connecting a power source to a discharged battery with clamps. In particular, the present invention relates to battery cables having a light source for illuminating objects near the clamps.

2. Description of Related Art

The use of battery cables is well known in the prior art. As may be appreciated, these devices are potentially hazardous in the creation of sparks as the cables are connected or disconnected from the battery terminals. Also, it is important that each cable is connected to the proper battery terminal to eliminate short circuiting the power source. Numerous attempts have been made to develop jumper cables having indicating systems that effectively indicate proper battery connection. Many of these types of systems utilize LED's, or other visual indicators, which illuminate when the cables are properly connected. U.S. Pat. Nos. 4,938,712; 4,869,688; and 4,840,583; each disclose such a system. However, each of these systems requires a connection to the battery to be boosted before indication.

Often, jumper cables must be connected when it is dark or otherwise poorly lighted. Darkness makes it difficult to see the battery posts and ensure that the jumper cables' connectors are properly secured to the terminals. Furthermore, it is very difficult to identify the polarity of the battery terminals and jumper cable connections in the dark.

U.S. Pat. No. 5,367,243 discloses a retractable jumper cable attachment comprising a flashlight. A conventional flashlight is connected to both the positive and negative jumper cables. The connection is such that a switch enables the flashlight to be powered either by the battery to which the jumper cable is attached or to batteries contained in the flashlight in the traditional manner.

An improvement over the '243 design is disclosed in U.S. Pat. No. 6,254,426, in which an independent voltage source, such as a small battery, is carried within the grip portion of a battery clamp. This electrical power source is connected through a switch to a light source, which is mounted on the clamp. However, explosive gases may accumulate near a booster battery or the battery to be charged, and opening or closing an electrical circuit using a switch on the clamp can cause a spark that may ignite these gases. In addition, locating the electrical power source in the clamp may also lead to the creation of sparks if the batteries fit loosely within the clamp or otherwise break electrical contact during use. A similar design is shown in U.S. Pat. No. 5,420,767, though the design is directed toward clamps not used for electrical connections to a battery.

Although there have been significant developments over the years in the area of battery jumper cables, considerable shortcomings remain.

SUMMARY OF THE INVENTION

There is a need for a battery cable assembly having a light source mounted on at least one battery clamp and powered by an independent electrical power source located away from the clamp, the light source being operated with a switch also located away from the clamp.

Therefore, it is an object of the present invention to provide a battery cable assembly having a light source mounted on at least one battery clamp and powered by an independent electrical power source located away from the clamp, the light source being operated with a switch also located away from the clamp.

This object is achieved by providing a battery cable assembly having a pair of electrical cables and at least one pair of clamps, each clamp being connected to one end of one of the cables for establishing electrical connection between the cables and electrical terminals of a battery. A light source is mounted on at least one of the clamps, the light source being powered by an electrical power source that is independent of the battery and located remote to the clamps. A switch, which is also located remote to the clamps, controls the flow of electricity from the electrical power source to the light source, allowing an operator to selectively activate the light source for illuminating objects near the corresponding clamp prior to or during connection to the battery.

The present invention provides significant advantages, including: (1) the ability to selectively illuminate battery terminals or other objects prior to connection of the battery cables to a battery; (2) the ability to locate the electrical power source for the light source and the switch for operating the light source away from the clamps, thereby preventing ignition of any explosive gases that may have accumulated near a battery; and (3) the ability to readily retrofit the illumination system onto existing jumper cables.

BRIEF DESCRIPTION OF THE DRAWINGS

For a more complete understanding of the present invention, including its features and advantages, reference is now made to the detailed description of the invention taken in conjunction with the accompanying drawings in which like numerals identify like parts, and in which.

DETAILED DESCRIPTION OF THE PREFERRED EMBODIMENT

The present invention is directed to a lighted battery cable assembly, permitting the user to correctly attach the assembly to a battery in all lighting conditions.

Figures 1, 3:
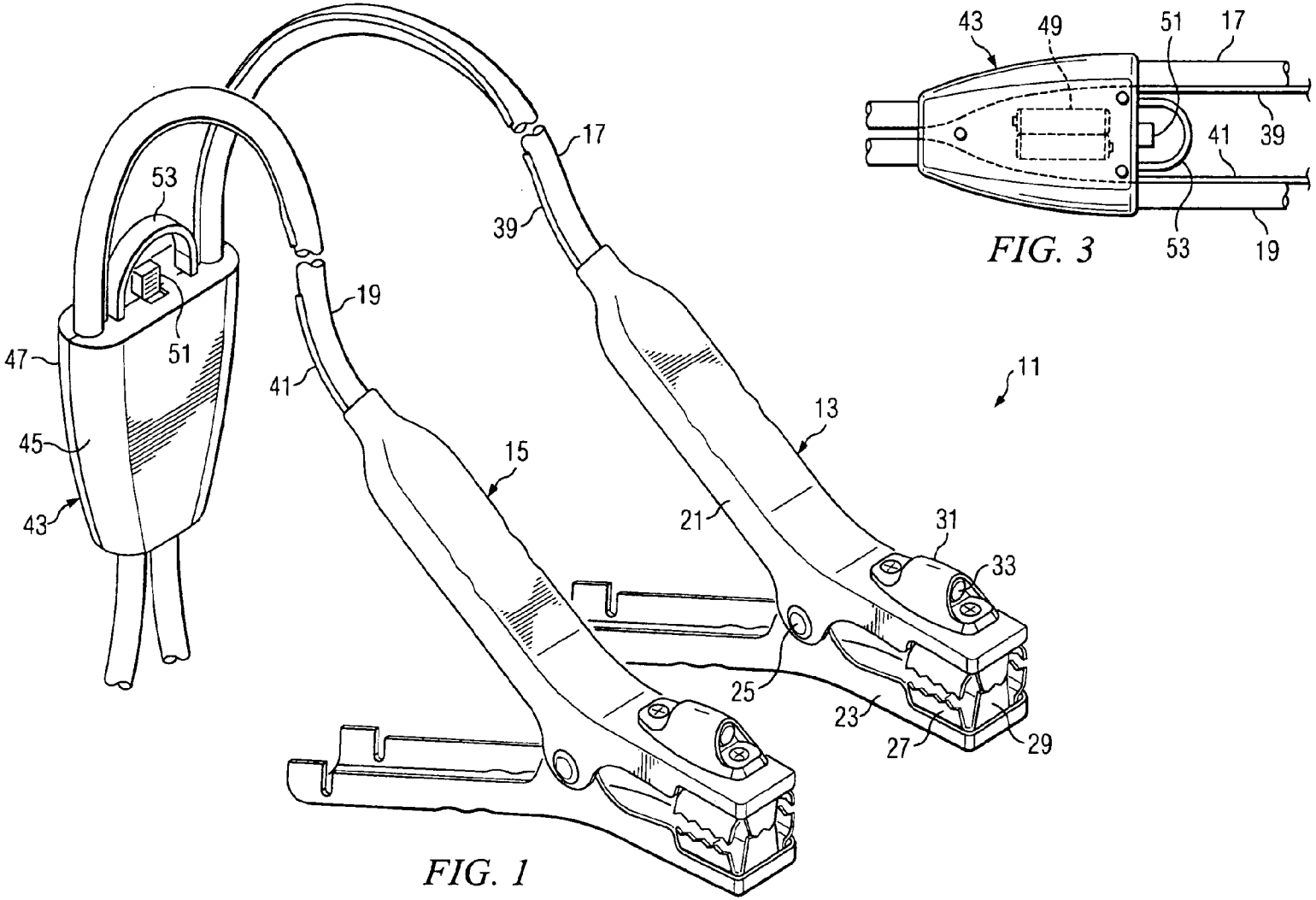
FIG. 1 is a perspective view of a battery cable assembly according to the present invention.
FIG. 3 is a perspective view of a battery pack according to the invention.

Referring now to FIG. 1, battery cable assembly 11 comprises two battery clamps 13, 15 for connecting insulated electrical cables 17, 19, respectively, to electrical terminals of a battery (not shown), such as the type of battery commonly used in an electrical system of an automobile. Clamps 13, 15 are shown as being identical, and it will be appreciated that the following description of clamp 13 also applies to clamp 15, though clamps 13, 15 may be dissimilar in other embodiments. Clamps 13, 15 are shown as clamps formed of pivoting sections, though clamps 13, 15 may also be of any type known in the art. For example, clamps 13, 15 may have portions that slide relative to each other.

Clamp 13 is formed from two clamp portions 21, 23, which are pivotally connected to each other by a fastener 25. Electrical contacts 27, 29 are mounted near an outer end of each of clamp portions 21, 23 and are formed to have serrated or similar edges for gripping a battery terminal and ensuring electrical contact. Clamp portions 21, 23 are preferably spring biased toward a closed position, as shown, such that contacts 27, 29 of opposing clamp portions 21, 23 are urged toward each other. Contacts 27, 29 on clamp portion 21 of clamp 13 are in electrical contact with cable 17, and contacts 27, 29 on clamp portion 21 of clamp 15 are in electrical contact with cable 19. When clamps 13, 15 are attached to battery terminals, electricity can flow between cables 17, 19 and the attached battery. For providing electrical power to the battery, the ends of cables 17, 19 opposite clamps 13, 15 may be attached, either with clamps or other conductive fastening means, to a charging system, a booster battery, a fixed electrical power source, or a portable electrical power source, such as an emergency jump-start pack. In order to allow cables 17, 19 to be used as jumper cables between batteries, cables 17, 19 may have clamps 13, 15 located on each end of cables 17, 19.

Figure 2:
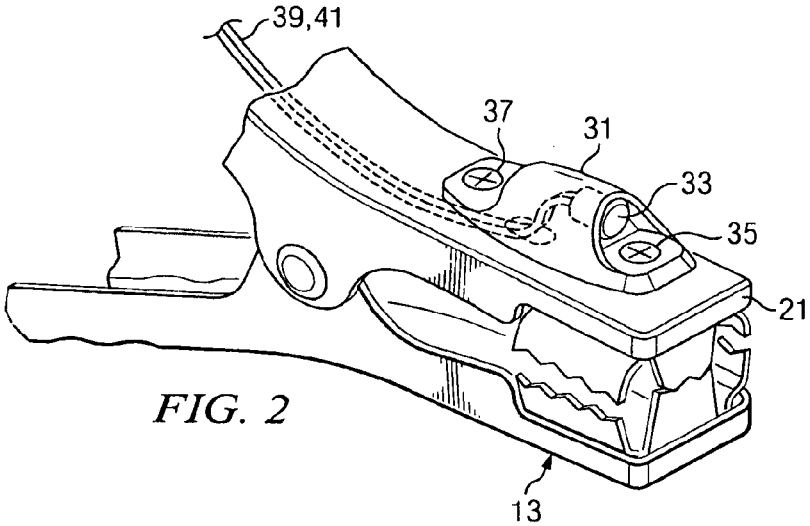
FIG. 2 is a perspective view of a portion of a battery clamp according to the invention

A lighting system is attached to clamps 13, 15 for selectively illuminating objects near clamps 13, 15 during use. For example, the lighting system may be used to illuminate battery terminals for proper placement of clamps 13, 15, or for determining the polarity for the terminals to ensure connection of the correct cable. A housing 31 is mounted to an upper surface of clamp 13, 15 for positioning a light source 33 near the outer end of clamp 13, 15. As shown in FIG. 2, housing 31 may be attached to clamp portion 21 by fasteners 35, 37, which may be rivets, bolts, or screws, or by other means, such as adhesives and adhesive tapes (not shown). Electrical wires 39, 41 are connected to light source 33 for conducting electrical power to light source 33. Light source 33 may be an incandescent bulb, one or more light-emitting diodes (LED's), cold cathode ray tubes, or similar electrically powered illuminators. Light source 33 is preferably oriented to cast light in a direction parallel to the length of clamps 13, 15, thereby providing illumination of nearby objects when electrical power is supplied to light source 33.

Referring again to FIG. 1 and to FIG. 3, a battery pack 43 comprises two members 45, 47 that assemble to form a housing for enclosing a voltage source that operates independently of the batteries or other voltage sources connected through cables 17, 19. Members 45, 47 also cooperate to locate and affix battery pack 43 a distance from clamps 13, 15 on cables 17, 19. FIG. 3 shows cables 17, 19 extending through battery pack 43. This configuration reduces the profile of battery pack 33. In addition, in applications where battery pack 43 is located at the fork where cables 17, 19 are joined, battery pack 43 provides reinforcement for the joint. Battery pack 43 preferably encloses small batteries 49, (shown in phantom in FIG. 3) which are connected to light source 33 by wires 39, 41. A switch 51 controls the flow of electricity from batteries 49 to light source 33, which allows the user to selectively activate light source 33 on clamps 13, 15 regardless of whether cable assembly 11 is connected to any outside electrical power source. Switch 51 may be of a sliding type, as shown, a rocker, or a push-button, and may be of a momentary type. In the preferred embodiment, an optional guard 53 protects switch 51 for inadvertent actuation.

During use in a darkened setting, a user may selectively actuate switch 51 to cause a current to flow through wires 39, 41 and light source 33. Clamps 13, 15 may then be moved near a battery to allow the user to illuminate objects, such as the battery terminals or polarity markings on the battery. Battery pack 43 is located a distance from clamps 13, 15, thereby minimizing the chance that a spark in switch 51 will ignite any explosive gases that may have accumulated around the battery that is to be connected to cables 17, 19. The use of an independent electrical power source, such as batteries 49 in battery pack 43, allows the user to activate light source 33 prior to connecting clamps 13, 15 to any outside electrical power source.

Figure 4:
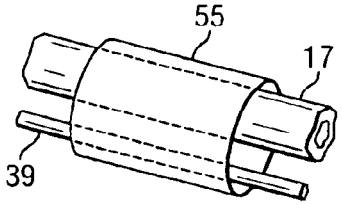
FIG. 4 is a side view of a battery cable and a wire prior to assembly, a shrink-wrap tube shown in phantom.
Figure 6:
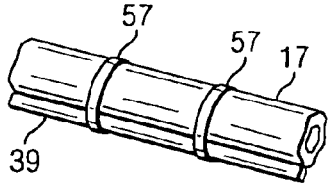
FIG. 6 is a side view of an alternate embodiment of the invention showing the cable and wire of FIG. 4 assembled together.
Figure 5:
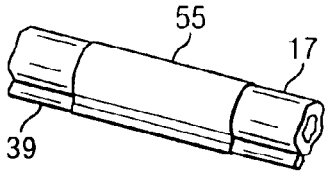
FIG. 5 is a side view showing the cable and wire of FIG. 4 assembled together.

As shown in FIGS. 1 and 3, wires 39, 41 are shown formed together with insulated cables 39, 41 for connecting battery pack 43 to clamps 13, 15. The integration of wires 39, 41 into the insulation of cables 39, 41 can be performed via simple molding and/or extrusion processes. However, wires 39, 41 and cables 17, 19 may alternatively be formed separately and assembled together. For example, FIG. 4 shows wire 39 and cable 17 positioned near each other with a protective shrink-wrap sleeve 55, or similar sleeve, shown in phantom for encircling wire 39 and cable 17. When sleeve 55 is heated, the radius of sleeve 55 decreases, drawing wire 39 and cable 17 toward each other and affixing wire 39 to cable 17 in an assembly, as shown in FIG. 5. An additional method of affixing wire 39 to cable 17 is shown in FIG. 6, in which bands 57 are used to hold wire 39 adjacent cable 17.

It will be appreciated that the present invention may be used in a retrofit application in which light source 33 and independent battery pack 43 are installed onto existing jumper cables. The assembly methods of FIGS. 4–6 are particularly well suited for retrofit applications.

Figure 7:
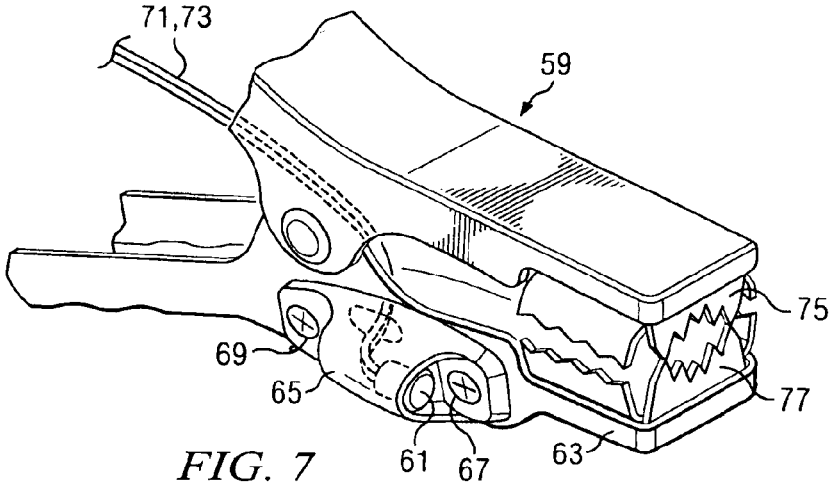
FIG. 7 is a perspective view showing a front portion of a battery clamp according to a second embodiment of the invention.

A second embodiment of the invention is shown in FIG. 7. Clamp 59 has the same construction as clamp 13, described above, but a light source 61 is mounted to a lateral surface of clamp portion 63 in a housing 65, thereby positioning light source 61 to one side of clamp 59. Fasteners 67, 69 may be used to attach housing 65 to clamp portion 63, and wires 71, 73 connect light source to battery pack 43 (FIG. 3). It will be appreciated that housing 65 may also be attached to clamp portion 63 by rivets, bolts, or screws, or by other means, such as adhesives and adhesive tapes (not shown).

In addition, it should be understood that housing 65 may also be mounted to any of the interior surfaces of clamp portion 63. Such configurations allow for added protection of housing 65 and lighting source 61, and provide for added clearance of clamp 59, thereby allowing clamp 59 to be used in applications in which the battery terminals are hard to reach or are in confined spaces. In these applications, electrical contacts 75, 771 which are mounted near the outer end of clamp 59 and which are formed to have serrated or similar edges for gripping the battery terminals and ensuring electrical contact, may be shaped or configured to allow the light from light source 61 to shine therethrough.

In another alternate embodiment, the switch for activating the light source may be operably associated with the clamp, such that when the clamp is squeezed to separate the clamp portions, the light source is turned on, and when the clamp portions are allowed to close together, the light source is turned off.

The present invention provides significant advantages over the prior art. The battery cables of the invention provide for the ability to selectively illuminate battery terminals or other objects prior to connection of the battery cables to a battery or any other outside electrical power source. By locating the power source of the light source and the switch for operating the light source away from the battery clamps, the danger of ignition of explosive gases that have accumulated near a battery is minimized. Also the invention provides for the ability to readily retrofit the illumination system onto existing jumper cables.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description.

We claim:

1. A clamp for connecting an electrical cable to a battery terminal comprising:

a pair of opposing clamp portions adapted for conductive coupling to the battery terminal, at least one of the clamp portions being conductively coupled to the cable for conducting electricity between the battery and the cable;

a light source located on at least one of the clamp portions for illuminating objects near the clamp portions when an electric current is supplied to the light source;

an independent electrical power source for providing the electric current to the light source, the electrical power source being conductively coupled to the light source and located remote from the clamp portions; and a switch for controlling the flow of the electric current to the light source, the switch also being located remote from the clamp portions.

2. The clamp according to claim 1, wherein the clamp portions are spring biased for urging the clamp portions toward each other.

3. The clamp according to claim 1, wherein the electrical power source is a battery pack.

4. The clamp according to claim 3, wherein the switch is carried by the battery pack.

5. The clamp according to claim 1, wherein the electrical power source is mounted on the cable.

6. The clamp according to claim 1, wherein the light source is an incandescent bulb.

7. The clamp according to claim 1, wherein the light source is at least one light-emitting diode.

8. The clamp according to claim 1, wherein the light source is mounted on one of the clamp portions.

9. The clamp according to claim 1, wherein the light source is mounted on the clamp portion connected to the cable.

10. The clamp according to claim 1, wherein the light source is mounted on an upper surface of one of the clamp portions.

11. The clamp according to claim 1, wherein the light source is mounted on a lateral surface of one of the clamp portions.

12. The clamp according to claim 1, further comprising:

electrical leads for conductively coupling the electrical power source to the light source.

13. The clamp according to claim 12, wherein the leads are integral with the cable.

14. The clamp according to claim 12, further comprising:

a protective sleeve for encasing the cable and the electrical leads.

15. The clamp according to claim 12, further comprising:

at least one band for coupling the leads to the cable.

16. The clamp according to claim 1, wherein the switch is operably associated with the clamp portions, such that the flow of the electric current to the light source is activated upon separation of the clamp portions.

17. The clamp according to claim 1, wherein the light source is mounted on an interior surface of the clamp portions.

18. A battery cable assembly comprising:

a pair of electrical cables, each cable having a first end and a second end;

a clamp member conductively coupled to the first end of each cable;

a light source mounted on at least one of the clamp members for providing illumination;

an independent electrical power source for supplying electrical power to the light source, the electrical power source being located remote from the clamp member; and a switch for selectively controlling the electrical power source, the switch being located remote from the clamp member.

19. The battery cable assembly according to claim 18, wherein the cables are joined together in the middle such that the first ends and the second ends of the cables are separated by forked joints, and wherein the electrical power source is connected to the cables at the forked joint of the first ends.

20. The battery cable assembly according to claim 18, wherein the second ends of the cables are conductively coupled to additional clamp members.

21. The battery cable assembly according to claim 18, wherein the second ends of the cables are adapted for conductive coupling to a second electrical power source.

22. The battery cable assembly according to claim 21, wherein the second electrical power source is a battery.

23. The battery cable assembly according to claim 21, wherein the second electrical power source is an emergency jump-start pack.

24. A battery jumper-cable assembly comprising:

a pair of electrical cables, each cable terminating in a clamp member adapted for connection to an electrical terminal of a battery;

a light source mounted on at least one of the clamp members;

at least one independent electrical power source for supplying electrical power to the light source, each independent electrical power source being located remote from the clamp members; and a switch operably associated with each independent electrical power source for selectively controlling the electrical power, each switch being located remote from the clamp members.

* * * * *